US006140993A

United States Patent [19]

Pathak et al.

[11] Patent Number: 6,140,993

[45] Date of Patent: Oct. 31, 2000

[54] CIRCUIT FOR TRANSFERRING HIGH VOLTAGE VIDEO SIGNAL WITHOUT SIGNAL LOSS

[75] Inventors: Saroj Pathak, Los Altos Hills; James E. Payne, Boulder Creek; Glen A. Rosendale, Palo Alto; Nianglamching Hangzo, San Jose, all of Calif.

[73] Assignee: Atmel Corporation, San Jose, Calif.

[21] Appl. No.: 09/097,866

[22] Filed: Jun. 16, 1998

[51] Int. Cl.[7] ..... G09G 3/36

[52] U.S. Cl. ..... 345/100; 345/204; 327/94

[58] Field of Search ..... 345/87, 92–100, 345/204; 349/41–43, 46; 327/94

[56] References Cited

U.S. PATENT DOCUMENTS

| | | | |
|---|---|---|---|
| 4,582,395 | 4/1986 | Morozumi | 350/334 |
| 4,840,460 | 6/1989 | Bernot et al. | 350/333 |
| 4,859,997 | 8/1989 | Bouron et al. | 340/752 |
| 5,105,288 | 4/1992 | Senda et al. | 359/57 |
| 5,248,963 | 9/1993 | Yasui et al. | 345/98 |
| 5,296,847 | 3/1994 | Takeda et al. | 345/92 |
| 5,349,366 | 9/1994 | Yamazaki et al. | 345/92 |
| 5,457,420 | 10/1995 | Asada | 327/437 |
| 5,461,501 | 10/1995 | Sato et al. | 359/59 |
| 5,465,054 | 11/1995 | Erhart | 326/34 |
| 5,469,090 | 11/1995 | Narahara | 327/58 |
| 5,510,731 | 4/1996 | Dingwall | 326/63 |
| 5,576,730 | 11/1996 | Shimada et al. | 345/98 |
| 5,576,858 | 11/1996 | Ukai et al. | 359/59 |
| 5,644,331 | 7/1997 | Hazama | 345/99 |
| 5,717,418 | 2/1998 | Shapiro et al. | 345/89 |
| 5,723,986 | 3/1998 | Nakashiro et al. | 326/81 |
| 5,729,246 | 3/1998 | Masuko | 345/98 |
| 5,903,248 | 5/1999 | Irwin | 345/90 |
| 5,907,314 | 5/1999 | Negishi et al. | 345/103 |

*Primary Examiner*—Steven J. Saras
*Assistant Examiner*—Srilakshmi Kumar
*Attorney, Agent, or Firm*—Thomas Schneck

[57] ABSTRACT

A circuit for transferring high voltage analog video signals while enabling the use of conventional low voltage logic levels includes a first transistor powered by a high voltage power source to bias a pass transistor at a high voltage level. The pass transistor receives a high voltage video signal and because of the high voltage bias is able to pass the video signal without attenuation of the signal due to feedthrough effects, thus preserving the fidelity of the video signal. A second transistor provides a ground potential which operates to turn OFF the pass transistor, thus disabling the transfer of the video signal therethrough. A third transistor operatively coupled to the first transistor operates to turn OFF the first transistor when the second transistor is in operation.

22 Claims, 4 Drawing Sheets

CIRCUIT FOR TRANSFERRING HIGH VOLTAGE VIDEO SIGNAL WITHOUT SIGNAL LOSS

TECHNICAL FIELD

The present invention generally relates to video displays and more particularly such to displays with capacitive elements and to circuitry for transferring and storing high voltage video signals without signal loss.

BACKGROUND ART

The pixels in a liquid crystal display typically consist of a matrix of thin-film transistors (TFTs) which are used to transfer a voltage to the liquid crystal capacitor comprising each pixel of the display. Gray scale imaging using liquid crystal displays typically involve dividing each pixel into a plurality of subunits. A desired gray level is obtained by activating an appropriate number of such subunits. For example, U.S. Pat. No. 4,840,460 discloses a liquid crystal display that is subdivided into a plurality of subpixels. Each subpixel includes an effective capacitor, with the liquid crystal material contained between the capacitor plates. A control capacitor is coupled is coupled in series with the effective capacitor. The capacitance of the control capacitors can be controlled, thereby activating the subpixels as a function of the applied voltage across the series capacitance. Gray scale imaging is achieved by activating an appropriate number of subpixels for each pixel. U.S. Pat. No. 5,576,858 teaches a similar structure of subpixels. These approaches result in a complex pixel structure, and thus increase the manufacturing difficulties in liquid crystal panel fabrication.

A property of liquid crystal material is that the transmissivity of the material to light is proportional to the voltage applied to the material. While a high voltage level will cause the liquid crystal material to become opaque, exposing the material to lower voltages results in the attenuation of light passing through the material. Thus, by storing an appropriate charge at each pixel region in a liquid crystal layer gray scale imaging can be obtained using a much simpler structure than prior art approaches. However, a faithful reproduction of an image requires accurate storage of charge at each pixel.

Liquid crystal panels are commonly used in computer display systems. The proliferation of laptop units creates a demand for energy efficient displays, owing to the fact that a laptop has a limited independent source of power.

What is needed, therefore, is circuitry which can transfer a video signal to a plurality of pixels without degrading the quality of the signal. It is desirable to provide circuitry which, for the most part, operates at low voltage levels typical of CMOS devices, but which can operate at the high voltage levels typically encountered with the display of video signals on a liquid crystal panel. It is further desirable that low voltage operation be maintained whenever possible and that high voltage operation is active only during the creation of the image on the liquid crystal panel, thus keeping to a minimum the power requirement of the liquid crystal display.

SUMMARY OF THE INVENTION

In accordance with the present invention, a video signal transfer circuit for transferring an analog video signal from a video input node to a video output node in response to receiving a select signal features a pass transistor having a source-drain connection between the video input node and the video output node; a second transistor coupled to receive the select signal at a first terminal thereof; a third transistor coupled to provide a voltage potential greater than the maximum voltage level of the video signal to the gate of the pass transistor in response to receiving a first logic level at the second transistor; a fourth transistor coupled to turn off the third transistor in response to receiving a second logic level at the second transistor; and a fifth transistor coupled to provide ground potential to the gate of the pass transistor in response to receiving the second logic level at the second transistor.

Further in accordance with the present invention, a video display circuit for receiving and displaying an analog video signal includes at least one video signal storage element, a first transistor coupled to receive the video signal and to pass the signal to the storage element. A first drive circuit biases the first transistor in a manner that the video signal is passed, unattenuated, in response to receiving a first select signal. A second transistor is coupled to a video source and passes a received video signal to the first transistor, unattenuated, in response to receiving a second select signal.

BEST MODE FOR CARRYING OUT THE INVENTION

Figure 1A:
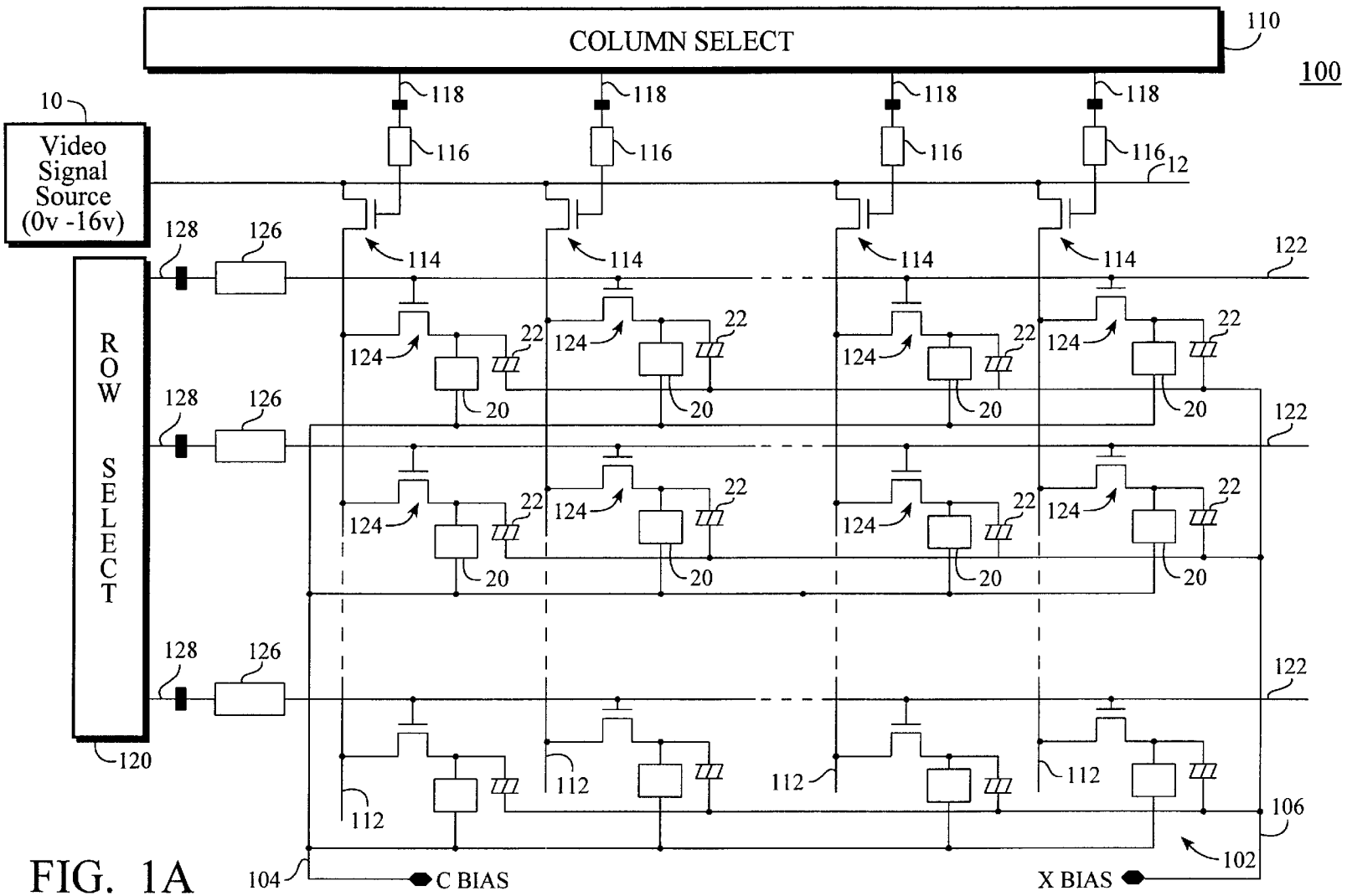
FIGS. 1A and 1B show a video display chip in accordance with the invention.

A video display chip 100 in accordance with the present invention comprises an array 102 of video storage elements 20, as shown in FIG. 1A. A liquid crystal layer formed atop the array of storage elements responds locally to the presence of a charge stored in a storage element 20. The liquid crystal layer is separated from storage elements 20 by an insulative layer (not shown). Consequently, the area of the liquid crystal layer above each storage element is capacitively coupled to it. These areas in the liquid crystal layer are represented schematically by capacitor elements 22. Typically, the liquid crystal layer is coupled to ground potential. This is shown schematically by a conductive line 106 representing a ground plane where XBIAS is ground. The electric field from the charge stored in a storage element 20 and its corresponding capacitive element 22 affects the transmissivity of light through the liquid crystal layer; a greater stored charge, and hence a greater resulting electric field, causes the liquid crystal to become more opaque.

Continuing, a column selector 110 outputs logic signals via a plurality of column select lines 118 to provide column addressing of the array. Column select lines 118 feed into column driver circuitry 116, each of which has an output that controls the gate of a column pass transistor 114. Similarly, a row selector 120 outputs logic signals via a plurality of row select lines 128 to provide row addressing of the array. Row select lines 128 feed into a plurality of row driver circuitry 126, each of which has an output that controls the gate of a row pass transistor 124. Thus, each video storage element 20 is individually addressed by proper selection of a column select line and a row select line. In the preferred embodiment of the invention, column selector 110 and row selector 120 are CMOS devices powered by $V_{[cc]}$, which for CMOS devices is typically a 5V power rail. Consequently, the column and row logic signals vary between one of two voltage levels, namely 0V and 5V.

A video signal source 10 provides the video signal to be stored in video storage elements 20. The video signal is a continuous analog signal having a signal range between 0V and 16V. A video signal line 12 is coupled via pass transistors 114 to deliver the video signal to column lines 112. Column lines 112, in turn, are coupled to storage elements 20 via pass transistors 124 so as to deliver the video signal to individually selected storage elements.

Figure 2:
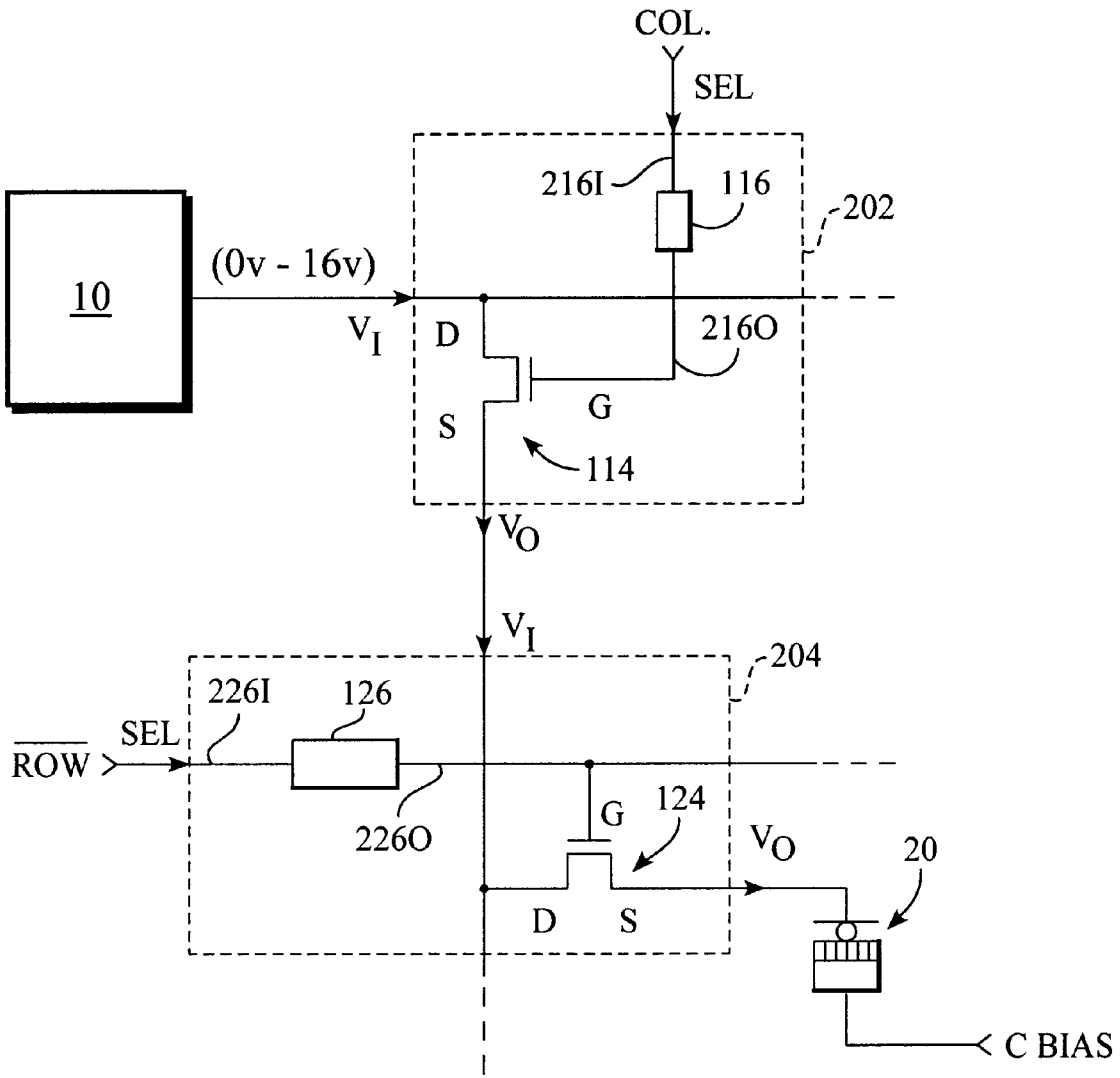
FIG. 2 illustrates the signal flow owing to the circuitry of the present invention.

Referring now to FIG. 2, a selected column and row define video signal transfer circuitry 202 and 204, respectively, which cooperate to transfer the analog video signal to a target video storage element 20. Each video signal transfer circuit includes a select input SEL, a video signal input VI, and a video signal output VO. Video signal transfer circuit 202 comprises column driver circuit 116 and column select transistor 114. Column select line 118 is coupled to select input SEL which feeds into an input 216I of driver circuit 116. An output 216O of driver circuit 116 feeds into the gate G of transistor 114. Video signal line 12 is coupled to video input VI which feeds into the drain terminal D of transistor 114, passing the video signal to its source terminal S as video output VO and onto column line 112.

Video signal transfer circuit 204 comprises row driver circuit 126 and row select transistor 124. Row select line 128 is coupled to select input SEL which feeds into an input 226I of driver circuit 126. An output 2260 of driver circuit 126 feeds into the gate G of transistor 124. Column line 112 is coupled to video input VI which feeds into the drain terminal D of transistor 124, passing the video signal to its source terminal S as video output VO and into storage element 20, which in the preferred embodiment is a capacitive element.

Figure 1B:
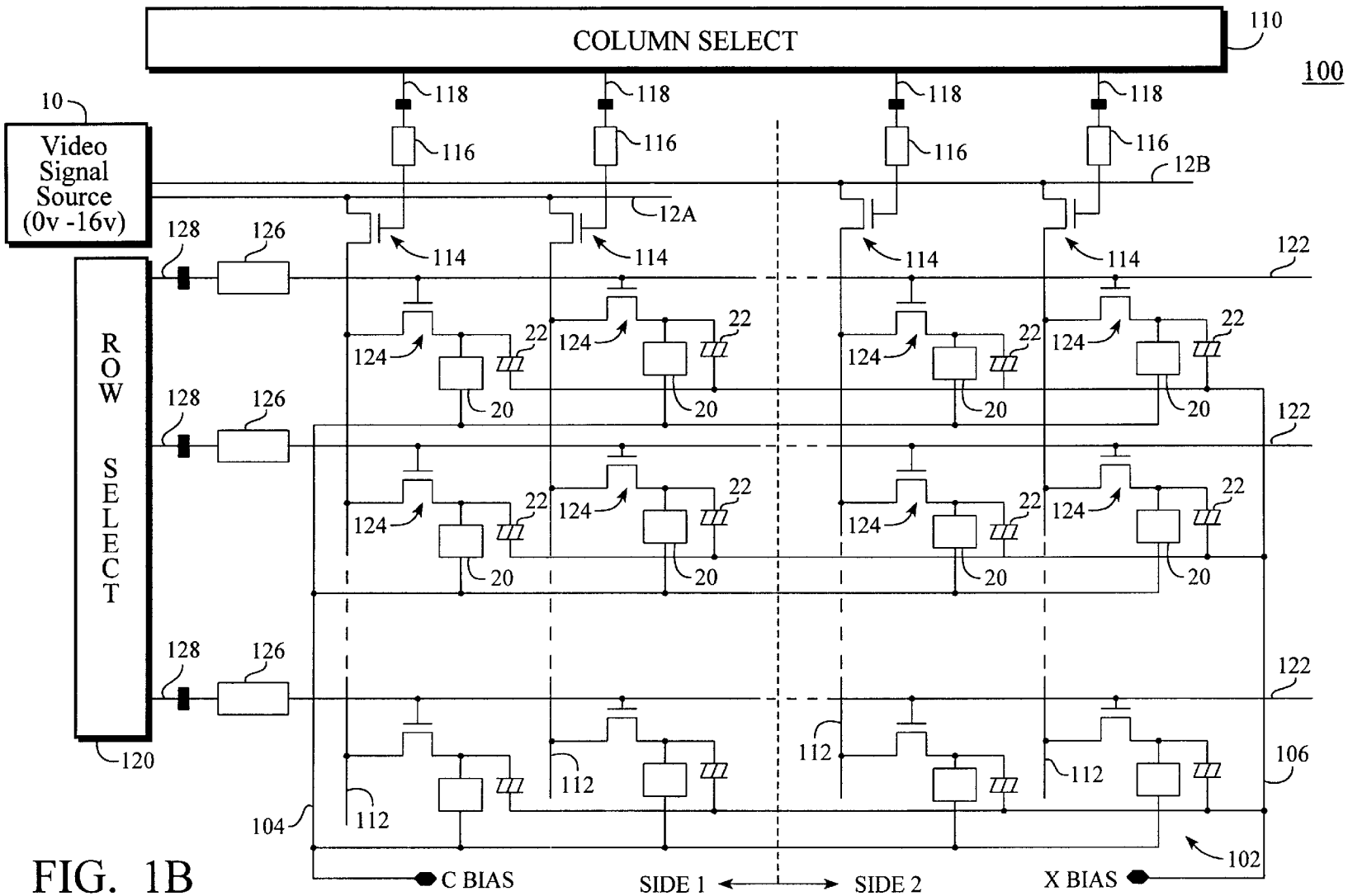

Turn for a moment to FIGS. 1A and 1B. Video source 10 of the embodiment shown in FIG. 1A provides a single video signal line 12 which feeds into each column of array 102. Thus, storage elements 20 are loaded with a video image in sequential order, each element being addressed and charged up with the appropriate charge from video signal line 12. Alternatively, video source 10 can be designed to provide two or more video signal lines as shown by video signal lines 12A and 12B in FIG. 1B. In this embodiment, array 102 is divided into side 1 and side 2. Video signal line 12A feeds the column lines 112 belonging to side 1 and video signal line 12B feeds the column lines 112 of side 2. This embodiment has the advantage of allowing for a faster loading of a video image by splitting the image into two halves and loading each half simultaneously, albeit at the expense of additional circuitry for proper synchronization of the split image.

Figure 3B:
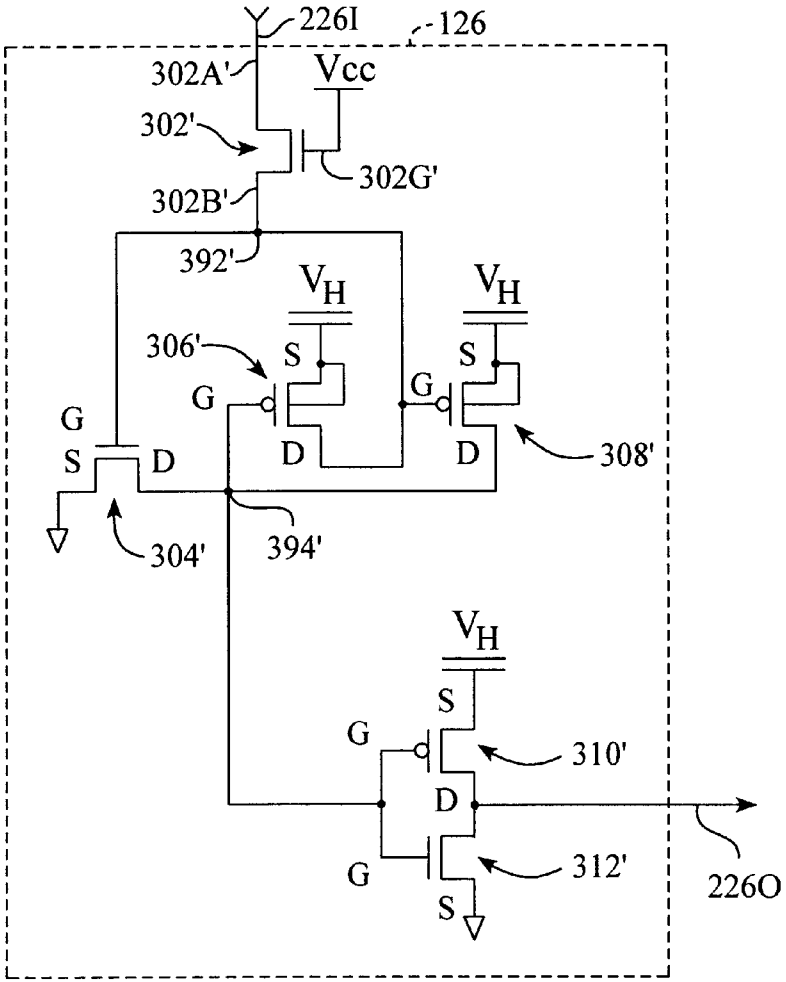
FIGS. 3A and 3B show the driver circuits of the invention.
Figure 3A:
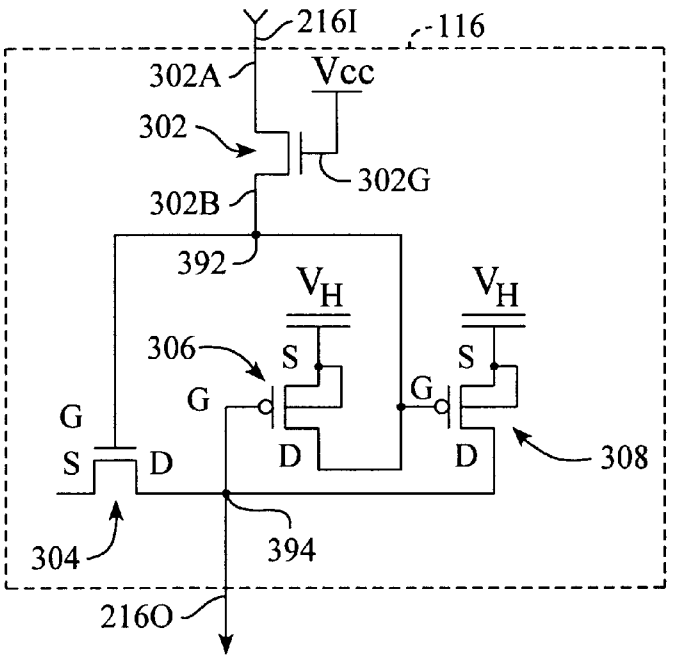

With reference to FIGS. 3A and 3B, shown are the column and row driver circuits 116 and 126 respectively the video signal transfer circuitry 202 and 204. Column driver circuit 116 comprises an input terminal 216I that is coupled to a first terminal 302A of N-channel MOS transistor 302. A second terminal 302B is coupled to a node 392. The gate terminal 302G is coupled to $V_{cc}$, typically a 5V power rail as mentioned above. A P-channel MOS transistor 308 has a gate terminal coupled to node 392, a source terminal coupled to $V_h$, and a drain terminal coupled to a node 394. In accordance with the invention, $V_h$ is greater than the maximum voltage level of the video signal, namely 16V. In the preferred embodiment of the invention, $V_h$ is an 18V power rail. A second P-channel MOS transistor 306 has a gate terminal coupled to node 394, a source terminal coupled to $V_h$, and a drain terminal coupled to node 392. A second N-channel transistor 304 has a gate terminal coupled to node 392, a source terminal to ground, and a drain terminal coupled to node 394. Finally, node 394 is coupled to output terminal 216O of video signal transfer circuit 116.

With reference to FIG. 3B, row driver circuit 126 comprises an input terminal 216I' that is coupled to a first terminal 302A' of N-channel MOS transistor 302'. A second terminal 302B' is coupled to a node 392'. The gate terminal 302G' is coupled to $V_{cc}$. A P-channel MOS transistor 308' has a gate terminal coupled to node 392', a source terminal coupled to $V_h$, and a drain terminal coupled to a node 394'. A second P-channel MOS transistor 306' has a gate terminal coupled to node 394', a source terminal coupled to $V_h$, and a drain terminal coupled to node 392'. A second N-channel transistor 304' has a gate terminal coupled to node 392', a source terminal to ground, and a drain terminal coupled to node 394'. Node 394' is coupled to the gate terminals of a third P-channel transistor 310 and a third N-channel transistor 312. Third transistors 310 and 312 have a common drain connection, which in turn is coupled to output terminal 226O of video signal transfer circuit 126. The source terminal of third PMOS transistor 310 is coupled to $V_h$, while the source terminal of third NMOS transistor 312 is coupled to ground.

Operation of the video signal transfer circuitry will now be discussed with reference to the FIGS. 2 and 3A. Consider first, video transfer circuit 202 shown in FIG. 2 and the associated driver circuit 116 shown in FIG. 3A. The voltage appearing at input terminal 216I is going to be either 0V or 5V, recalling that the column select signal is either 0V or 5V ($V_{cc}$). Consider the first case where column selector 110 outputs a column select signal at a first logic level, feeding 0V into input terminal 216I. Since transistor 302 is always ON by virtue of its gate being coupled to $V_{cc}$, node 392 will also be at 0V. This has the effect putting transistor 304 in a non-conducting state. However, transistor 308, a P-channel device, becomes conductive, bringing node 394 to a potential equal to $V_h$. In addition, transistor 306 is put in a non-conductive state by virtue of the high potential ($V_h$) at node 394. Continuing with FIG. 2, the gate terminal of transistor 114, being coupled to node 394, is biased at $V_h$ thus turning ON the transistor.

Recall that a transistor is conductive so long as the gate-to-source voltage is greater than the threshold voltage $V_{th}$ of the transistor. Since the gate of transistor 114 is biased at $V_h$, the source terminal of conducting transistor 114 can rise to a voltage level equal to $V_h$–$V_{th}$. Since $V_h$ is 18V and $V_{th}$ is typically 0.7V, the source terminal of pass transistor 114 can rise to a potential roughly equal to 17.3V. Since the video signal has a maximum voltage level of 16V, the drain terminal will see a maximum voltage level of 16V which can be transferred to the source terminal, leaving approximately a 1.3V margin for error. Thus, video transfer circuit 202 is capable of selectively transferring a video signal from its video input line VI to its video output line VO without any degradation to the video signal.

Consider next the case where column selector 110 outputs a column select signal at a second logic level, feeding a 5V potential into input terminal 216I switches to 5V. Node 392 will rise to approximately 4.3V, assuming Vth of transistor 302 is 0.7V. This will have the effect of turning ON transistor 304 which will take node 394 to ground potential. This in turn will turn OFF pass transistor 114, thus preventing the transfer of the video signal from video input line VI to video output line VO.

Notice, however, that transistor 308 remains in the conductive state despite the 4V bias on its gate terminal, and thus burns power by virtue of the ground path through transistor 304. The reason transistor 308 remains ON is that its $V_{gs}$ remains greater than its $V_{th}$, recalling that transistor 308 is P-channel and $V_g$ is at 4V and $V_S$ is at $V_h$=18V. In order to turn OFF transistor 308, its gate potential must be raised to a potential greater than $V_h$–$V_{th}$. Transistor 306 provides the needed potential. Since node 394 is at ground potential, transistor 306 becomes conductive and its drain terminal begins to rise to a potential of $V_h$. This will take the gate terminal of transistor 308 to a potential sufficient to turn it OFF.

Since the drain of transistor 306 is coupled to node 392, the potential at node 392 will also rise to $V_h$. This high potential would be damaging if it passed back to the circuitry of column selector 110. Transistor 302, however, serves to block $V_h$. The potential at terminal 302A is 5V and the potential at terminal 302B is at $V_h$, and since transistor 302 is an N-channel device, terminal 302A acts as the source and terminal 302B serves as the drain. As such, transistor 302 becomes non-conducting when $V_h$ appears at node 392 because $V_{gs}$ is less than the transistor's $V_{th}$. The effect is that the high potential at node 392 does not pass back into the circuitry comprising column selector 110, being blocked by transistor 302.

Referring now to FIGS. 2 and 3B, it can be seen that operation of video signal transfer circuit 204 in connection with the row select signal is virtually identical to the foregoing discussion in connection with transfer circuit 202. Drive circuit 126, however, includes two additional transistors 310 and 312. In accordance with the preferred embodiment of the present invention, the row select signal is active LOW, as indicated in FIG. 2. Transistors 310 and 312 therefore are configured as an inverter to reverse the polarity of the control signal that feeds into the gate terminal of pass transistor 124. Note that the inverter circuit is powered by $V_h$. This is to ensure that the HIGH output of the inverter circuit is at $V_h$ in order to properly bias the gate terminal of pass transistor 124 for the reason as discussed in connection with pass transistor 114.

In summary, video signal transfer circuit 202 transfers the analog video signal appearing at video input line VI to video output line VO when a 0V logic level is presented at select line SEL. Conversely, transfer circuit 202 blocks the video signal from video output line VO when a 5V logic level is presented. Similarly, video signal transfer circuit 204 passes the video signal when the row select signal is at a logic level of 5V and blocks the video signal for a logic level of 0V. Thus, by appropriately setting the column and row select signals, the video signal can be transferred to any of the storage elements 20.

The video transfer circuits 202 and 204 permit the use of a low power source ($V_{cc}$) to power most of the systems of the video display chip, while at the same time providing unattenuated transfer of high voltage video signals. By limiting the use of $V_h$ only to the transfer circuitry, the power requirements of the display chip are kept to a minimum.

What is claimed is:

1. A video signal transfer circuit for transferring an analog video signal from a video input node to a video output node in response to receiving a select signal, the video signal having a maximum voltage level, the select signal having a first logic level and a second logic level, each of the logic levels being less than the maximum voltage level of the video signal, the circuit comprising:

a first transistor having a first terminal coupled to the video input node, thereby receiving the video signal, the first transistor further having a gate terminal and a second terminal coupled to the video output node;

a second transistor having a first terminal for receiving the select signal, the second transistor further having a second terminal and a gate terminal;

a third transistor having a first terminal coupled to a power supply line, the power supply line having a voltage potential greater than the maximum voltage level of the video signal, the third transistor further having a second terminal in electrical communication with the gate terminal of the first transistor and a gate terminal coupled to the second terminal of the second transistor;

a fourth transistor having a first terminal coupled to the power supply line, a second terminal coupled to the gate terminal of the third transistor, and a gate terminal in electrical communication with the gate terminal of the first transistor; and a fifth transistor having a first terminal coupled to ground potential, a second terminal in electrical communication with the gate terminal of the first transistor, and a gate terminal coupled to the second terminal of the second transistor.

2. The video signal transfer circuit of claim 1 further including an inverter circuit coupled between the second terminal of the third transistor and the gate terminal of the first transistor.

3. The video signal transfer circuit of claim 2 wherein the inverter circuit includes a PMOS-type transistor and an NMOS-type transistor having a common drain connection, a source terminal of the PMOS-type transistor being coupled to the power supply line, a source terminal of the NMOS-type transistor being coupled to ground potential.

4. A circuit for transferring an analog video signal having a maximum voltage level to one of a plurality of video storage elements, the video storage elements arranged in rows and columns, the video signal transfer circuit receiving a row select signal and a column select signal, the row and column select signals being at voltage levels less than the maximum voltage level of the video signal, the circuit comprising:

a first video signal transfer circuit having a first video input terminal to receive the video signal, a first video output terminal to which the video signal is transferred, and a column select terminal to receive the column select signal; and a second video signal transfer circuit having a second video input terminal coupled to the first video output terminal, a second video output terminal coupled to the video storage element, and a row select terminal to receive the row s elect signal;

the first video signal transfer circuit including:

a first node in electrical communication with the column select terminal;

a second node;

a first pass transistor having a first terminal coupled to the first video input terminal, a second terminal coupled to the first video output terminal, and a gate terminal coupled to the second node;

a first transistor coupled to provide, in response to receiving a first column select signal at the first node, a voltage level on the second node that is at least equal to the maximum voltage level of the video signal;

a second transistor coupled to turn off the first transistor in response to receiving a second column select signal at the first node; and a third transistor coupled to provide, in response to receiving the second column select signal at the first node, ground potential on the second node;

the second video signal transfer circuit including:

a third node in electrical communication with the row select terminal;

a fourth node;

a second pass transistor having a first terminal coupled to the second video input terminal, a second terminal coupled to the second video output terminal, and a gate terminal in electrical communication with the fourth node;

a fourth transistor coupled to provide, in response to receiving a first row select signal at the third node, a voltage level on the fourth node that is at least equal to the maximum voltage level of the video signal;

a fifth transistor coupled to turn off the fourth transistor in response to receiving a second row select signal at the third node; and a sixth transistor coupled to provide, in response to receiving the second row select signal at the third node, ground potential on the fourth node.

5. The circuit of claim 4 wherein:

the first, second, fourth and fifth transistors each has a first terminal coupled to a voltage potential that is greater than or equal to the maximum voltage level of the video signal;

the first transistor has a second terminal coupled to the second node and a gate terminal coupled to the first node;

the second transistor has a second terminal coupled to the gate of the first transistor and a gate terminal coupled to the second node;

the fourth transistor has a second terminal coupled to the fourth node and a gate terminal coupled to the third node; and the fifth transistor has a second terminal coupled to the gate of the fourth transistor and a gate coupled to the fourth node.

6. The circuit of claim 5 wherein the first, second, fourth and fifth transistors are PMOS-type transistors.

7. The circuit of claim 5 wherein the third and sixth transistors each has a first terminal coupled to ground potential, the third transistor has a second terminal coupled to the second node and a gate terminal coupled to the first node, and the sixth transistor has a second terminal coupled to the fourth node and a gate terminal coupled to the third node.

8. The circuit of claim 7 wherein the third and sixth transistors are NMOS-type transistors.

9. A circuit for transferring an analog video signal having a maximum voltage level to one of a plurality of video storage elements, the video storage elements arranged in rows and columns, the video signal transfer circuit receiving a row select signal and a column select signal, the row and column select signals being at voltage levels less than the maximum voltage level of the video signal, the circuit comprising:

a first video signal transfer circuit having a first video input terminal to receive the video signal, a first video output terminal to which the video signal is transferred, and a column select terminal to receive the column select signal; and a second video signal transfer circuit having a second video input terminal coupled to the first video output terminal, a second video output terminal coupled to the video storage element, and a row select terminal to receive the row select signal; wherein the first video signal transfer circuit including:

a first node in electrical communication with the column select terminal;

a second node;

a first pass transistor having a first terminal coupled to the first video input terminal, a second terminal coupled to the first video output terminal, and a gate terminal coupled to the second node;

a first transistor coupled to provide, in response to receiving a first column select signal at the first node, a voltage level on the second node that is at least equal to the maximum voltage level of the video signal;

a second transistor coupled to turn off the first transistor in response to receiving a second column select signal at the first node; and a third transistor coupled to provide, in response to receiving the second column select signal at the first node ground potential on the second node;

the second video signal transfer circuit including:

a third node in electrical communication with the row select terminal;

a fourth node;

a second pass transistor having a first terminal coupled to the second video input terminal, a second terminal coupled to the second video output terminal, and a gate terminal in electrical communication with the fourth node;

a fourth transistor coupled to provide, in response to receiving a first row select signal at the third node, a voltage level on the fourth node that is at least equal to the maximum voltage level of the video signal;

a fifth transistor coupled to turn off the fourth transistor in response to receiving a second row select signal at the third node;

a sixth transistor coupled to provide, in response to receiving the second row select signal at the third node, ground potential on the fourth node; and a seventh transistor and an eighth transistor, the seventh and eighth transistors each having a gate terminal coupled to the fourth node, the seventh and eighth transistors having a common drain connection coupled to the gate terminal of the second pass transistor.

10. The circuit of claim 9 wherein the seventh transistor is a PMOS-type transistor and the eighth transistor is an NMOS-type transistor.

11. A video display circuit comprising:

a video signal line for receiving a video signal, the video signal being a continuous voltage level between a minimum voltage level and a maximum voltage level;

a column selector having a plurality of column select lines;

a plurality of column drive circuits, each having an input coupled to one of the column select lines, each column drive circuit further having an output, each column drive circuit providing at its output a first voltage level substantially equal to ground potential and a second voltage level greater than the maximum voltage level of the video signal;

a plurality of column pass transistors, each having a first terminal coupled to the video signal line and a gate terminal coupled to the output of one of the a column drive circuits, each column pass transistor further having a second terminal;

a row selector having a plurality of row select lines;

a plurality of row drive circuits, each having an input coupled to one of the row select lines, each row drive circuit further having an output each row drive circuit providing at its output a first voltage level substantially equal to ground potential and a second voltage level greater than the maximum voltage level of the video signal;

a plurality of row pass transistors, each having a first terminal coupled to the second terminal of one of the column pass transistors and a gate terminal coupled to the output of one of the row drive circuits, each row pass transistor further having a second terminal;

an array of video storage elements arranged as a plurality of columns and rows, each having a first terminal coupled to the second terminal of one of the row pass transistors, each storage element further having a second terminal; and wherein each of the column and row drive circuits includes:

a first node in electrical communication with the drive circuit input;

a second node in electrical communication with the drive circuit output;

a first PMOS-type transistor having a gate terminal coupled to the first node and a drain terminal coupled to the second node;

a second PMOS-type transistor having a gate terminal coupled to the second node and a drain terminal coupled to the gate terminal of the first PMOS type transistor; and an NMOS-type transistor having a gate terminal coupled to the first node, a drain terminal coupled to the second node, and a source terminal for being coupled to a ground potential;

the first and second PMOS-type transistors each further having a source terminal coupled to a voltage potential that is greater than the maximum voltage level of the video signal.

12. The video circuit of claim 11 wherein each of the column and row drive circuits includes:

a first node in electrical communication with the drive circuit input;

a second node in electrical communication with the drive circuit output;

a first PMOS-type transistor having a gate terminal coupled to the first node and a drain terminal coupled to the second node;

a second PMOS-type transistor having a gate terminal coupled to the second node and a drain terminal coupled to the gate terminal of the first PMOS type transistor; and an NMOS-type transistor having a gate terminal coupled to the first node, a drain terminal coupled to the second node, and a source terminal for being coupled to a ground potential;

the first and second PMOS-type transistors each further having a source terminal coupled to a voltage potential that is at least equal to the maximum voltage level of the video signal, the row drive circuits each further includes a third PMOS-type transistor and a second NMOS-type transistor, the third PMOS-type transistor and the second NMOS-type transistor each having a gate terminal coupled to the second node and a drain terminal coupled to the drive circuit output.

13. The circuit of claim 11 wherein each of the column and row drive circuits includes:

a first node in electrical communication with the drive circuit input;

a second node in electrical communication with the drive circuit output;

a first PMOS-type transistor having a gate terminal coupled to the first node and a drain terminal coupled to the second node;

a second PMOS-type transistor having a gate terminal coupled to the second node and a drain terminal coupled to the gate terminal of the first PMOS type transistor; and an NMOS-type transistor having a gate terminal coupled to the first node, a drain terminal coupled to the second node, and a source terminal for being coupled to a ground potential;

the first and second PMOS-type transistors each further having a source terminal coupled to a voltage potential that is at least equal to the maximum voltage level of the video signal, each of the column and row drive circuits further includes a second NMOS-type transistor having a first terminal coupled to the drive circuit input and a second terminal coupled to the first node.

14. The circuit of claim 11 wherein the video signal storage element is a capacitor and the second terminal of the video signal storage element is coupled to ground potential.

15. The circuit of claim 11 wherein the video signal storage element is a capacitor and the second terminal of the video signal storage element is coupled to a voltage level greater than ground potential.

16. A video display circuit for receiving a video signal, the video signal having a maximum voltage level, the video display circuit comprising:

at least one video signal storage element having first and second terminals;

a first transistor having first and second terminals and a gate terminal, the first terminal coupled to the first terminal of the video signal storage element, the first transistor further having a first threshold voltage;

a second transistor having first and second terminals and a gate terminal, the first terminal coupled to the second terminal of the first transistor, the second terminal coupled to receive the video signal, the second transistor further having a second threshold voltage;

a first drive circuit having input and output terminals, the output terminal coupled to the gate terminal of the first transistor, the first drive circuit having a first output voltage level that is less than the first threshold voltage and a second output voltage level that is greater than the maximum voltage level of the video signal;

a second drive circuit having input and output terminals, the output terminal coupled to the gate terminal of the second transistor, the second drive circuit having a first output voltage level that is less than the second threshold voltage and a second output voltage level that is greater than the maximum voltage level of the video signal; and wherein each of the first and second drive circuits includes:

a first node in electrical communication with the drive circuit input terminal;

a second node in electrical communication with the drive circuit output terminal;

a first PMOS-type transistor having a gate terminal coupled to the first node and a drain terminal coupled to the second node;

a second PMOS-type transistor having a gate terminal coupled to the second node and a drain terminal coupled to the gate terminal of the first PMOS type transistor; and an NMOS-type transistor having a gate terminal coupled to the first node, a drain terminal coupled to the second node, and a source terminal for being coupled to a ground potential;

the first and second PMOS-type transistors each further having a source terminal coupled to a voltage potential that is greater than the maximum voltage level of the video signal.

17. The circuit of claim 16 wherein the first drive circuit further includes a third PMOS-type transistor and a second NMOS-type transistor, the third PMOS-type transistor and second NMOS-type transistor each having a gate terminal coupled to the second node and a drain terminal coupled to the drive circuit output terminal.

18. The circuit of claim 16 wherein each of the first and second drive circuits further includes a second NMOS-type transistor having a first terminal coupled to the drive circuit input terminal and a second terminal coupled to the first node.

19. The circuit of claim 16 further including a row select circuit having an output terminal coupled to the input terminal of the first drive circuit, and a column select circuit having an output terminal coupled to the input terminal of the second drive circuit.

20. The circuit of claim 19 wherein the row select circuit has a first output voltage level less than the first threshold voltage and a second output voltage level greater than the first threshold voltage and less than the maximum voltage level of the video signal, and the column select circuit has a first output voltage level less than the second threshold voltage and a second output voltage level greater than the second threshold voltage and less than the maximum voltage level of the video signal.

21. The circuit of claim 16 wherein the video signal storage element is a capacitor and the second terminal of the video signal storage element is coupled to ground potential.

22. The circuit of claim 16 wherein the video signal storage element is a capacitor and the second terminal of the video signal storage element is coupled to a voltage level greater than ground potential.

* * * * *